US008482200B2

(12) United States Patent
Onimaru et al.

(10) Patent No.: US 8,482,200 B2
(45) Date of Patent: Jul. 9, 2013

(54) PLASMA DISPLAY PANEL AND PROTECTIVE FILM PROTECTING ELECTRODES OF PLASMA DISPLAY PANEL

(75) Inventors: Toshiaki Onimaru, Ibaraki (JP); Hiroshi Sakurai, Takatsuki (JP); Yo Hibino, Ibaraki (JP); Toshiyuki Akiyama, Ibaraki (JP); Yoichi Shintani, Ibaraki (JP)

(73) Assignee: Panasonic Corporation, Osaka (JP)

( * ) Notice: Subject to any disclaimer, the term of this patent is extended or adjusted under 35 U.S.C. 154(b) by 220 days.

(21) Appl. No.: 13/027,568

(22) Filed: Feb. 15, 2011

(65) Prior Publication Data

US 2011/0221339 A1 Sep. 15, 2011

(30) Foreign Application Priority Data

Mar. 9, 2010 (JP) ..... 2010-051964

(51) Int. Cl.
*H01J 17/49* (2012.01)
*H01J 17/06* (2006.01)
*H01J 61/09* (2006.01)

(52) U.S. Cl.
USPC ..... 313/582; 313/613

(58) Field of Classification Search
None
See application file for complete search history.

(56) References Cited

U.S. PATENT DOCUMENTS

| | | | | |
|---|---|---|---|---|
| 4,233,623 | A * | 11/1980 | Pavliscak | 348/797 |
| 4,440,841 | A * | 4/1984 | Tabuchi | 430/5 |
| 6,075,578 | A * | 6/2000 | Hayashi et al. | 349/32 |
| 2007/0108905 | A1 | 5/2007 | Kurauchi et al. | |
| 2007/0222385 | A1 | 9/2007 | Kim et al. | |
| 2008/0085375 | A1 | 4/2008 | Kim et al. | |

FOREIGN PATENT DOCUMENTS

| | | |
|---|---|---|
| JP | 2007-095436 | 4/2007 |
| JP | 2007-119833 | 5/2007 |
| JP | 2007-157717 | 6/2007 |
| JP | 2008-098139 | 4/2008 |
| JP | 2009-004150 | 1/2009 |
| WO | WO 2006/049121 A1 | 5/2006 |

* cited by examiner

*Primary Examiner* — Britt D Hanley
(74) *Attorney, Agent, or Firm* — Antonelli, Terry, Stout & Kraus, LLP.

(57) ABSTRACT

A forming method of a protective film made of oxide containing any one of calcium oxide (CaO), strontium oxide (SrO) and barium oxide (BaO) and having a higher band gap than that of magnesium oxide (MgO) (higher than 7.9 eV) is provided. By adjusting a time constant of a protective film to a predetermined value or larger, the voltage drop time is adjusted so as to be usable for a plasma display panel. At this time, the time constant $\tau(=C\times R)$ defined by the discharge capacitance C and the protective film resistance R is referenced.

3 Claims, 6 Drawing Sheets

PLASMA DISPLAY PANEL AND PROTECTIVE FILM PROTECTING ELECTRODES OF PLASMA DISPLAY PANEL

CROSS-REFERENCE TO RELATED APPLICATIONS

The present application claims priority from Japanese Patent Application No. 2010-051964 filed on Mar. 9, 2010, the content of which is hereby incorporated by reference to this application.

BACKGROUND

The present invention relates to a material of a plasma display panel (PDP) used as a display device, and more particularly to a material for forming a protective film and a forming method thereof.

A plasma display panel is a display device in which a large number of minute sealed discharge spaces are provided between two glass substrates.

In an AC PDP commonly used at present, display electrodes of a front plate are covered with a dielectric layer and a protective film is formed on the dielectric layer that covers the display electrodes. This dielectric layer is provided for accumulating electric charge generated by voltage application to the electrodes. Further, the protective film is provided for preventing the damage on the dielectric layer due to the ion collision in discharge gas and for reducing the firing voltage by secondary electron emission.

In recent years, further improvement in efficiency (reduction of driving voltage) and improvement in display characteristics such as higher contrast have been demanded in PDP. In such circumstances, as a method for improving the efficiency of PDP, the increase of the xenon (Xe) concentration in discharge gas to about 15% has been examined.

However, the increase of the xenon concentration causes the problem of the increase of firing voltage and sustain voltage. Therefore, instead of magnesium oxide (MgO) which is a traditional material of the protective film, the use of calcium oxide (CaO), strontium oxide (SrO) and barium oxide (BaO) which are also alkali earth metal oxides and have higher secondary electron emission and the use of solid solution of these have been examined.

Japanese Patent Application Laid-Open Publication No. 2007-095436 discloses the use of calcium oxide (CaO), strontium oxide (SrO) and barium oxide (BaO) mentioned above.

Also, Japanese Patent Application Laid-Open Publication No. 2007-119833 discloses that a deposited film mainly made of strontium oxide (SrO) and calcium oxide (CaO) is formed as a protective film.

Japanese Patent Application Laid-Open Publication No. 2007-157717 describes that a first protective film made of a material having a work function lower than that of magnesium oxide (MgO) is formed and a second protective film containing magnesium oxide (MgO) is formed on the first protective film.

Japanese Patent Application Laid-Open Publication No. 2009-004150 describes that solid solution containing oxide of at least one element selected from a group including manganese (Mn), iron (Fe), cobalt (Co), nickel (Ni) and zinc (Zn) is disposed in a shape of a protective film.

Japanese Patent Application Laid-Open Publication No. 2008-098139 discloses that a protective film is formed by using magnesium oxide (MgO) as a main component and two doping materials through vacuum deposition.

International Patent Publication No. WO 2006/049121: U.S. Pat. No. 4,343,232 discloses a protective film made of strontium oxide (SrO) and calcium oxide (CaO).

SUMMARY

However, the band gap of magnesium oxide (MgO) is 7.9 eV. On the other hand, the band gap of calcium oxide (CaO) is 7.2 eV, that of strontium oxide (SrO) is 6.4 eV and that of barium oxide (BaO) is 4.8 eV. As described above, calcium oxide (CaO), strontium oxide (SrO) and barium oxide (BaO) have narrower band gap compared with magnesium oxide (MgO).

Therefore, the sufficient insulation characteristics for retaining electric charge cannot be maintained, and the problem of charge leakage occurs. Due to the charge leakage, the high memory characteristics (charge storage capability) required in PDP cannot be achieved, and problems such as the increase of applied voltage and the increase of background luminance occur.

Also, calcium oxide (CaO), strontium oxide (SrO) and barium oxide (BaO) are chemically unstable and have a problem of being hydroxylated or carbonated during the atmospheric process in the fabrication of PDP.

An object of the present invention is to provide a forming method of a protective film made of oxide containing any one of calcium oxide (CaO), strontium oxide (SrO) and barium oxide (BaO) and having a higher band gap than that of magnesium oxide (MgO) (higher than 7.9 eV).

The above and other objects and novel characteristics of the present invention will be apparent from the description of the present specification and the accompanying drawings.

The following is a brief description of an outline of the typical invention disclosed in the present application.

In a plasma display panel according to the typical embodiment of the present invention, electrodes are disposed on a front plate glass and a protective film for protecting the electrodes is formed, and the protective film contains oxide whose main component is any one of calcium oxide, strontium oxide and barium oxide and which has a higher band gap than that of magnesium oxide.

In this plasma display panel, the oxide having a higher band gap contains aluminum oxide.

In this plasma display panel, the main component is calcium oxide, and a composition ratio of calcium and aluminum is in a range from 99 mol:1 mol to 75 mol:25 mol.

In this plasma display panel, a time constant $\tau = C \times R$ defined by a discharge capacitance C of the protective film and a protective film resistance R is 5 ms or larger.

In these plasma display panels, the protective film is formed in a form of at least one of a deposited film and particles.

The protective film containing any one of calcium oxide (CaO), strontium oxide (SrO) and barium oxide (BaO) according to the present invention has a band gap higher than that of magnesium oxide (MgO). Therefore, it is possible to provide a protective film having good constant voltage characteristics with sufficient insulation characteristics capable of storing electric charge and also resistant to characteristic change during the atmospheric process in the fabrication of PDP.

DETAILED DESCRIPTION

Embodiments of the present invention will be described below with reference to the drawings.

First Embodiment

Figure 1:
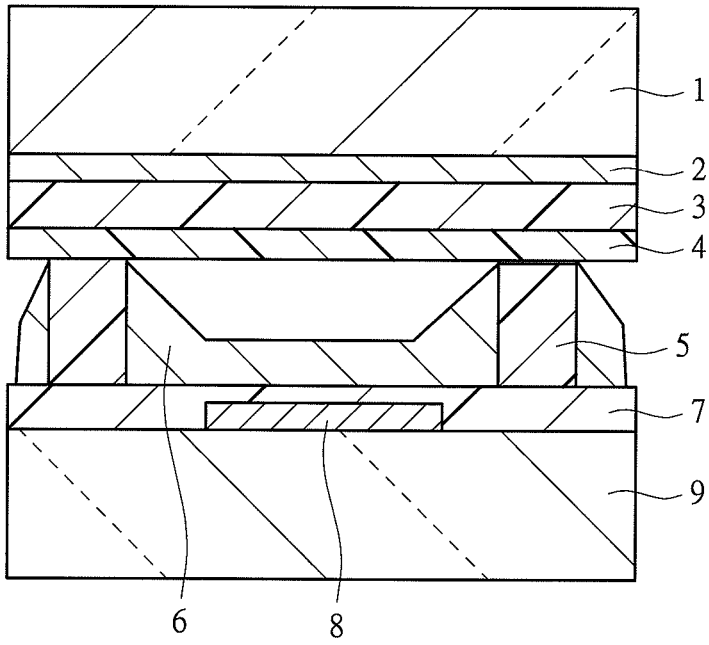
FIG. 1 is an enlarged cross-sectional view of PDP to which the protective film of the present invention is applied.

FIG. 1 is an enlarged cross-sectional view of the PDP to which the protective film of the present invention is applied.

This PDP is made up of a front plate glass 1, a display electrode 2, a dielectric layer 3, a protective film 4, ribs 5, a phosphor 6, a dielectric layer 7, an address electrode 8 and a rear plate glass 9.

The front plate glass 1 is a glass substrate to be a display surface of the PDP.

The display electrode 2 is a so-called X electrode and/or Y electrode provided on the front plate glass 1. Out of the (1) reset period, (2) address period and (3) sustain period corresponding to the operation cycle of the PDP, sustain pulses are input from a driving circuit (not shown) of each electrode in the (3) sustain period. Predetermined signals are input also in the (1) reset period and the (2) address period.

The dielectric layer 3 is a layer made of a dielectric material that covers the front plate glass 1 after the display electrode 2 is provided.

The protective film 4 is a protective film for preventing the damage on the dielectric layer 3 due to secondary electrons.

The rear plate glass 9 is a glass substrate which seals the discharge gas at a predetermined pressure together with the front plate glass 1.

The address electrode 8 is provided on this rear plate glass 9. The address electrode is driven by its driving circuit (not shown) in the (2) address period.

The dielectric layer 7 is a layer made of a dielectric material that covers the rear plate glass 9 after the address electrode 8 is provided.

The ribs 5 are provided on this dielectric layer 7. The phosphor 6 is coated between the ribs 5. The discharge space is isolated by the ribs 5 and the phosphor 6 responds to the plasma emission in this discharge space to emit light, thereby bringing the colored light to the operator of the PDP.

Note that phosphors of RGB (red, green and blue) and possibly phosphors of CMY (cyan, magenta and yellow) are used as the whole PDP. The frequency of the color output by the phosphor 6 is not particularly specified here.

In the present invention, oxide containing any one of calcium oxide (CaO), strontium oxide (SrO) and barium oxide (BaO) and having a higher band gap than that of magnesium oxide (MgO) is used as a material of the protective film 4.

The material used for the protective film 4 will be described below.

In the present invention, the protective film 4 is formed by the electron beam deposition method. This film formation is performed by the two-source deposition in which sources are provided at two positions.

When a single body of calcium oxide (CaO) is formed by the two-source deposition, these two sources are both CaO sources. Also, when wide band gap oxide is added to calcium oxide (CaO), one source is a calcium oxide (CaO) source and the other source is a wide band gap oxide source. Then, by simultaneously performing the film formation from the two sources, the calcium oxide (CaO)-wide band gap oxide is produced. When changing the composition of the CaO-wide band gap oxide, the film formation is performed while changing the deposition rates thereof. The composition of the formed film can be confirmed by the EDX (Energy Dispersive X-Ray) analysis.

In this embodiment, one source of the two-source deposition is the CaO source. Also, the other source thereof is an $Al_2O_3$ source. In such circumstances, the film formation is simultaneously performed to the front plate glass 1 at arbitrary deposition rates, thereby fabricating two types of PDP having a protective film with the composition of CaO: 10% Al and a protective film with the composition of CaO: 24% Al, respectively.

Figure 2:
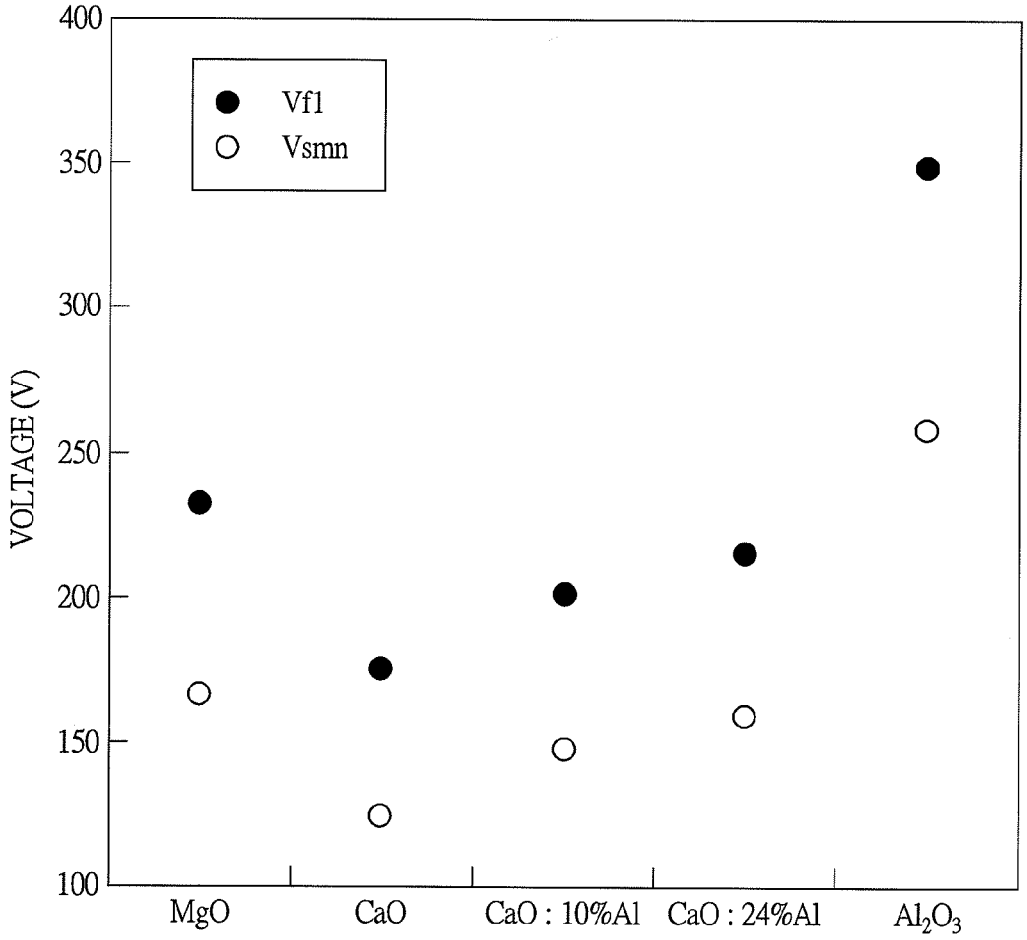
FIG. 2 is a graph showing the characteristics of the firing voltage of the two types of PDP of the present invention and the PDP having the protective film made of other components.

FIG. 2 is a graph showing the characteristics of the firing voltage of the two types of PDP of the present invention and the PDP having the protective film made of other components. The vertical axis represents the firing voltage (unit: volt) and the horizontal axis represents the materials for forming the protective film 4. In FIG. 2, Vf1 denotes the firing voltage (first on voltage) and Vsmn denotes the minimum sustain voltage (first off voltage).

Note that the discharge characteristics shown in this graph are measured not in panel but in chamber. The sealed gas conditions at this time are: Ne-20% Xe and 66.7 kPa.

As can be seen from the graph of FIG. 2, the order of voltages desirable for the application to the product (order from high voltage to low voltage) is: (1) $Al_2O_3$, (2) MgO and (3) CaO. Therefore, among these, the application of CaO is desirable and $Al_2O_3$ is not so desirable in terms of the power consumption.

It can be understood that the two types of product having a protective film with the composition of CaO: 10% Al and a protective film with the composition of CaO: 24% Al, respectively, according to the present invention do not discharge unless higher voltage than that of the case of the single body of calcium oxide (CaO) is applied, but the discharge is started by a voltage lower than that of the case of magnesium oxide (MgO).

Next, the phase difference characteristics thereof will be described.

Figure 3:
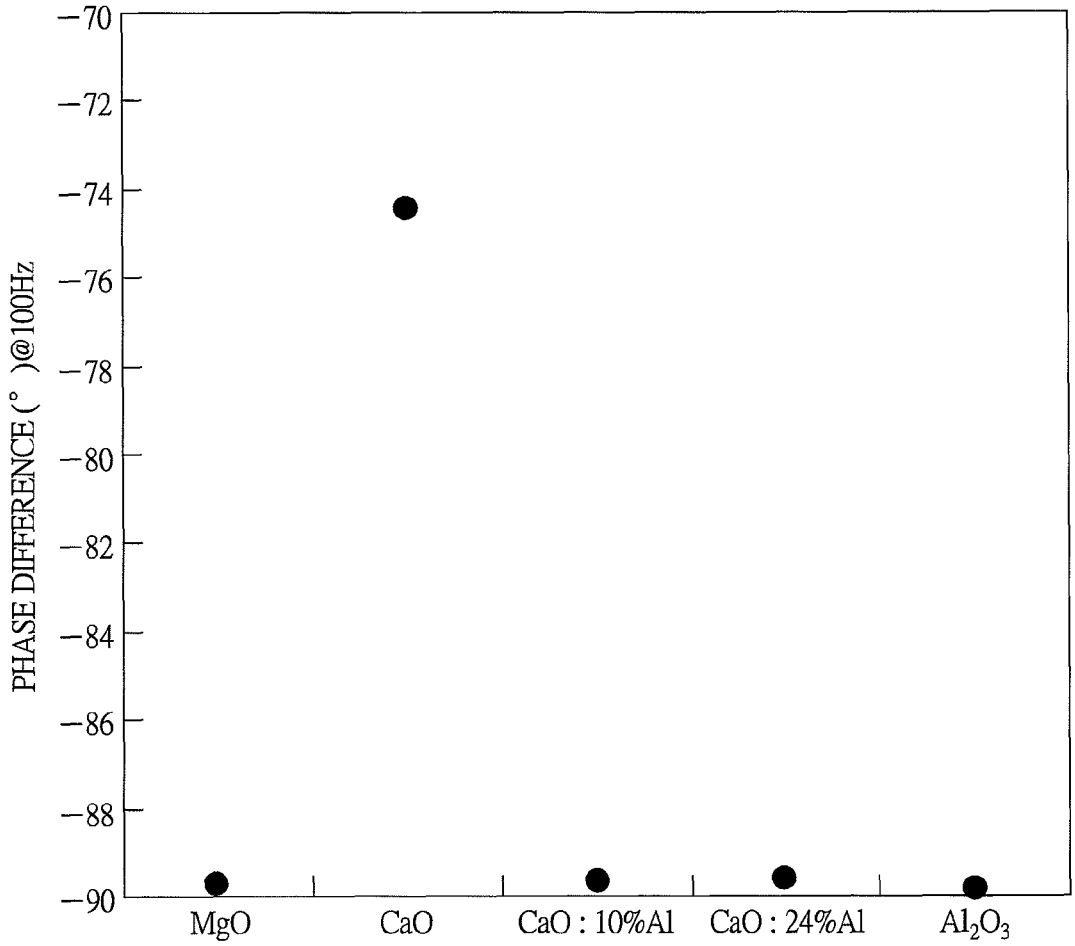
FIG. 3 is a graph showing the difference in phase characteristics at 100 Hz between the two types of PDP according to the present invention and the PDP having the protective film made of other components.
Figure 4:
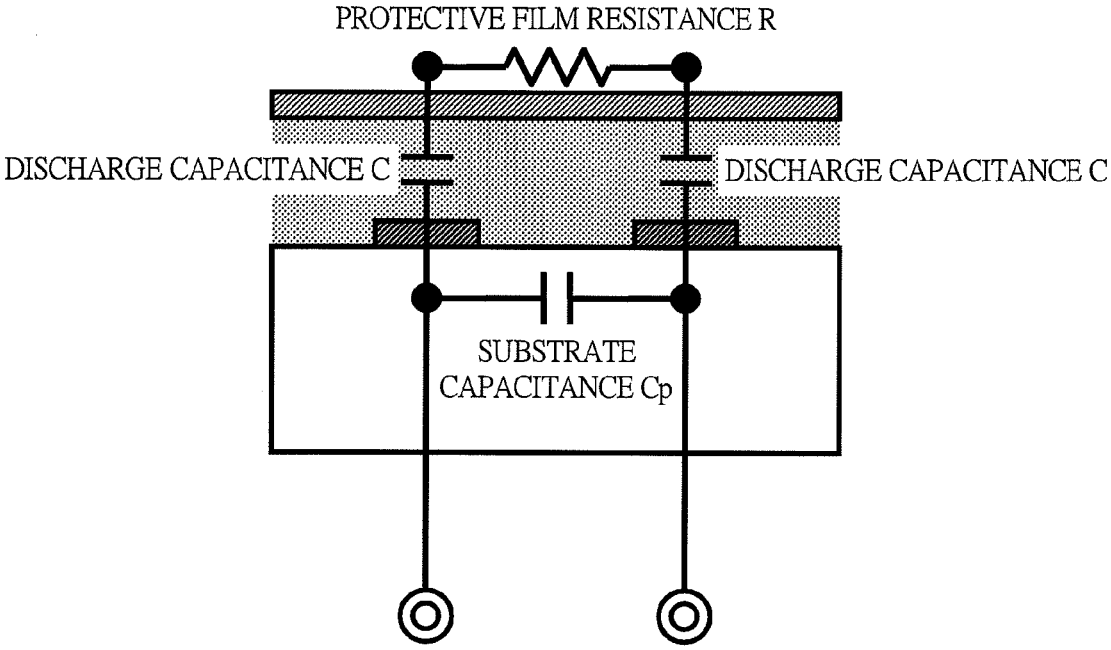
FIG. 4 is a conceptual diagram showing the equivalent circuit model for the measurement.

FIG. 3 is a graph showing the difference in phase characteristics at 100 Hz between the two types of PDP according to the present invention and the PDP having the protective film made of other components. The vertical axis represents the phase difference (unit: degree) and the horizontal axis represent the materials for forming the protective film 4. Although the description thereof is omitted, FIG. 4 is a conceptual diagram showing the equivalent circuit model for the measurement.

The calcium oxide (CaO) has a phase difference of −74°. This means that the resistance of direct current component exists and the wall charge cannot be retained.

Different from calcium oxide (CaO), the two types of product having a protective film with the composition of CaO: 10% Al and a protective film with the composition of CaO: 24% Al, respectively, have the phase difference of approximately −90°. This means that the resistance of direct current component does not exist and the wall charge can be retained in the AC PDP.

The reason why the protective film 4 has not been traditionally formed from the single body of CaO lies in this point. More specifically, since the protective film 4 made of a single body of CaO has a bigger problem than that made of MgO in terms of the retention of wall charge, the protective film 4 made of a single body of CaO cannot be used as it is. It can be understood from this drawing that the products having a protective film with the composition of CaO: 10% Al and a protective film with the composition of CaO: 24% Al, respectively, according to the present invention have good characteristics also in terms of the wall charge retention.

Furthermore, when the discharge of the accumulated wall charge is too fast, the problem occurs in the display of the plasma display. That is, the wall charge accumulated in the (2) address period cannot be sustained until the (3) sustain period.

Figure 5:
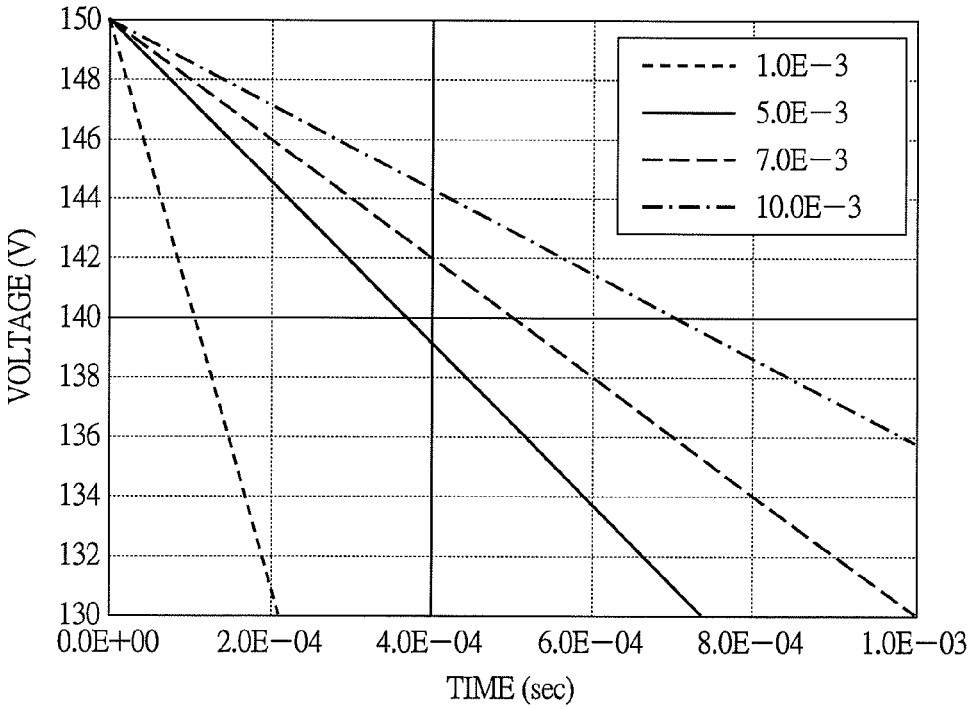
FIG. 5 is a graph showing a comparison of voltage decay curve with respect to time in the case where the time constant $\tau(-C\times R)$ defined by the discharge capacitance C and the protective film resistance component R differs in the impedance characteristics of the protective film.

FIG. 5 is a graph showing a comparison of voltage decay curve with respect to time in the case where the time constant $\tau(=C\times R)$ defined by the discharge capacitance C and the protective film resistance component R (see FIG. 4) differs in the impedance characteristics of the protective film 4. Note that, as a premise of this graph, the applied voltage is 150 V in all conditions.

As the driving conditions of the PDP, when the charge leakage of about 10 V is caused in the idle period for voltage sustain (voltage sustain period) of 400 μsec to 500 μsec, the problems on the driving of PDP (increase of applied voltage, increase of background emission) occur. The protective film 4 is formed so as to satisfy the requirements. More specifically, the slope needs to be moderated in FIG. 5. When the voltage sustain period is set to 500 μsec, although the voltage sustain period is slightly insufficient, the above-described requirements are almost satisfied if the time constant $\tau$ is about 5 ms (5.0E-3).

Note that the description above has been made on the assumption that calcium oxide (CaO) is used as a main component. However, the similar effects can be achieved also when strontium oxide (SrO) or barium oxide (BaO) is used as a main component.

By selecting the oxide from the point of view as described above, the protective film having both of low voltage characteristics and insulation characteristics capable of storing electric charge can be provided in the present invention.

Second Embodiment

Next, the second embodiment of the present invention will be described.

Similar to the first embodiment, the second embodiment also assumes that the two types of PDP in which the protective film 4 with the composition of CaO: 10% Al and the protective film 4 with the composition of CaO: 24% Al are respectively formed by the two-source deposition are fabricated.

Figure 6:
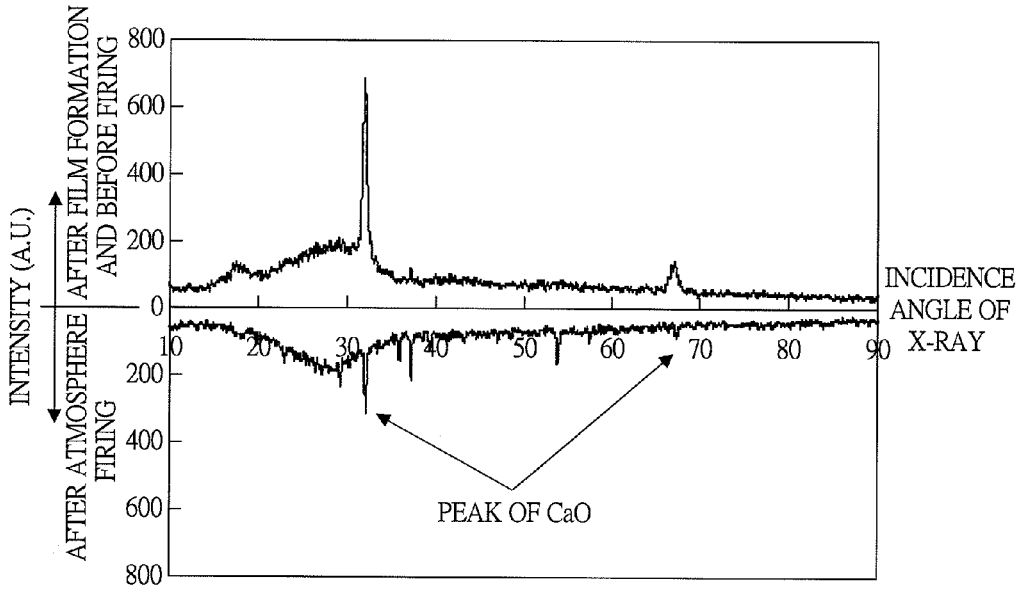
FIG. 6 is a graph showing the change in XRD (X-Ray Diffraction) between before and after the atmosphere firing of the protective film made of the single body of calcium oxide (CaO) for examination.
Figure 7:
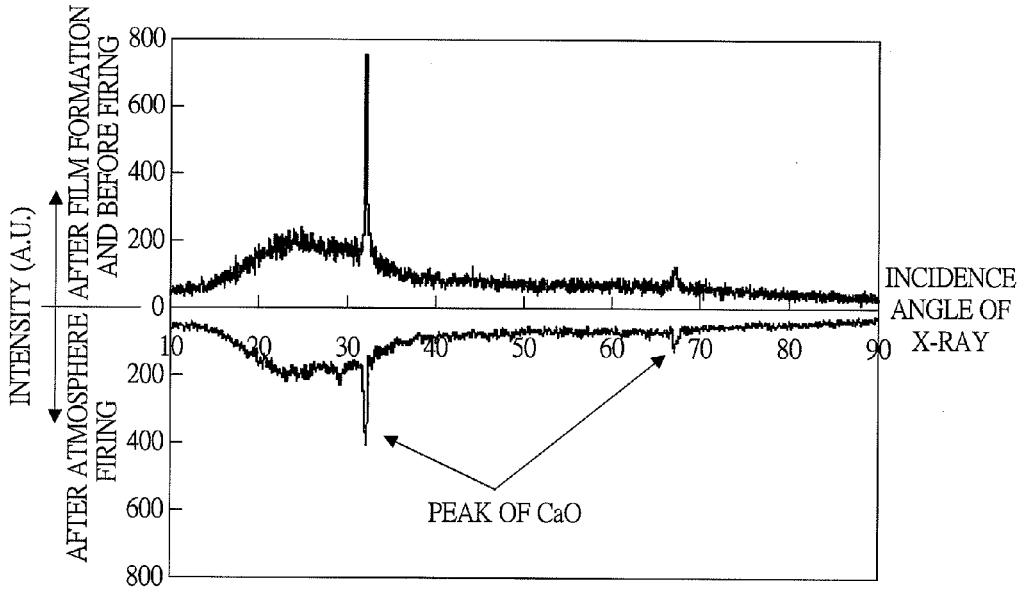
FIG. 7 is a graph showing the change in XRD between before and after the atmosphere firing of the protective film with the composition of calcium oxide (CaO): 10% aluminum (Al) according to the present invention.
Figure 8:
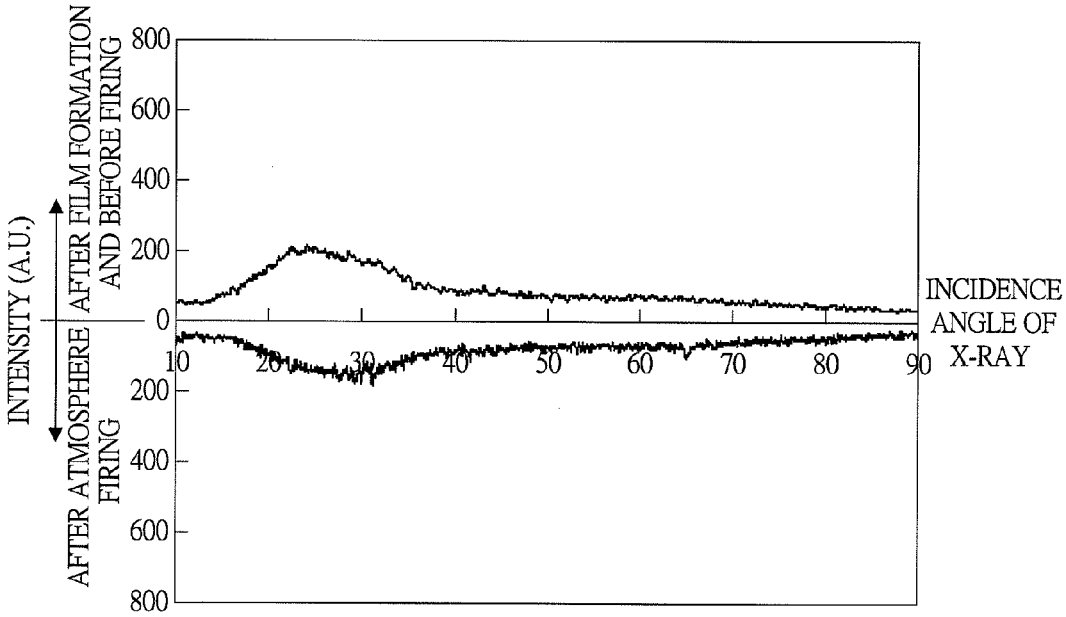
FIG. 8 is a graph showing the change in XRD between before and after the atmosphere firing of the protective film with the composition of calcium oxide (CaO): 24% aluminum (Al) according to the present invention.

FIG. 6 is a graph showing the change in XRD (X-Ray Diffraction) between before and after the atmosphere firing of the protective film 4 made of the single body of calcium oxide (CaO) for examination. Also, FIG. 7 is a graph showing the change in XRD between before and after the atmosphere firing of the protective film with the composition of calcium oxide (CaO): 10% aluminum (Al) according to the present invention. Further, FIG. 8 is a graph showing the change in XRD between before and after the atmosphere firing of the protective film with the composition of calcium oxide (CaO): 24% aluminum (Al) according to the present invention. Note that the condition of the atmosphere firing is: 465° C.×45 minutes.

First, the graph of FIG. 6 is considered. In this graph, the vertical axis represents the intensity (unit: A.U.) and the horizontal axis represents the incidence angle of the X-ray to the sample. Also, the upper half of the vertical axis represents the intensity after the film formation and before the firing and the lower half of the vertical axis represents the intensity after the firing in this graph. It should be noted that both the upper half and the lower half of the vertical axis represent the positive values. The same is true for FIG. 7 and FIG. 8.

The upper half of the vertical axis of the graph, that is, the intensity before the firing is first considered.

The protective film 4 is made of the single body of calcium oxide (CaO) in FIG. 6. Therefore, the peak intensity of the protective film 4 is almost equal to that of calcium oxide (CaO). The peak occurs at a position of the incidence angle just over 30° and a position of the incidence angle just under 70°.

The existence of the peak means that the protective film 4 is not amorphous. This is said to be desirable because the advantage of longer product life can be achieved when there is the peak.

On the other hand, after the firing, peaks occur also at the points other than the two points described above, and the intensity at each peak is lowered. This means that calcium oxide (CaO) is transformed in the firing process. The peaks other than those of the calcium oxide (CaO) are the peaks of carbonate.

Although the transformation to carbonate can be easily observed, the peaks of calcium oxide (CaO) can be obviously specified in FIG. 6.

Next, the case of calcium oxide (CaO): 10% aluminum (Al) according to the present invention is considered with reference to FIG. 7.

In this case of calcium oxide (CaO): 10% aluminum (Al), the angle at which the peak occurs and the intensity at the peak before the firing are almost equal to those of FIG. 6. On the other hand, after the firing, the peaks are smaller in number compared with FIG. 6. Although a weak peak of carbonate is observed around 29°, the peaks are located at almost the same points as those before the firing. More specifically, it can be found that the transformation at the firing can be improved by the solid solution of $Al_2O_3$.

Then, the case of calcium oxide (CaO): 24% aluminum (Al) in FIG. 8 is considered. At the time of the film formation, no diffraction peak exists in the protective film 4 made of calcium oxide (CaO): 24% aluminum (Al). This means that the protective film 4 is amorphous. This is probably because the solid solution exceeds the solid solution limit of calcium oxide (CaO) with respect to aluminum (Al) and neither of CaO and $Al_2O_3$ appear as crystals.

From the foregoing, it can be understood that the use of the protective film 4 made of oxide with the composition of calcium oxide (CaO): 10% aluminum (Al) is desirable as a product in terms of the product life.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention can be applied to a protective film formed on a front glass substrate of PDP.

What is claimed is:

1. A plasma display panel in which electrodes are disposed on a front plate glass and a protective film for protecting the electrodes is formed, wherein the protective film contains calcium oxide and aluminum oxide, and a composition ratio of calcium and aluminum is in a range from 99 mol:1 mol to 75 mol:25 mol.

2. The plasma display panel according to claim 1, wherein a time constant $\tau = C \times R$ defined by a discharge capacitance C of the protective film and a protective film resistance R is 5 ms or larger.

3. The plasma display panel according to claim 1, wherein the protective film is formed in a form of at least one of a deposited film and particles.

* * * * *